US007303267B2

(12) United States Patent
Yuen

(10) Patent No.: US 7,303,267 B2
(45) Date of Patent: Dec. 4, 2007

(54) ACTUATOR FOR AUTOMATIC INK REFILL SYSTEM

(76) Inventor: Kenneth Yuen, P.O. Box 208, San Gabriel, CA (US) 91776

( * ) Notice: Subject to any disclaimer, the term of this patent is extended or adjusted under 35 U.S.C. 154(b) by 104 days.

(21) Appl. No.: 10/817,424

(22) Filed: Apr. 2, 2004

(65) Prior Publication Data

US 2005/0219333 A1 Oct. 6, 2005

(51) Int. Cl.
*B41J 2/175* (2006.01)
*B65D 69/00* (2006.01)

(52) U.S. Cl. ..... 347/85; 206/223

(58) Field of Classification Search ..... 347/85, 347/86, 87; 141/2, 18, 19, 319; 206/223, 206/461

See application file for complete search history.

(56) References Cited

U.S. PATENT DOCUMENTS 4,183,031 A 1/1980 Kyser et al.
4,723,688 A * 2/1988 Munoz ..... 222/88
4,842,028 A 6/1989 Kaufman et al.
4,995,751 A * 2/1991 Saint Georges Chaumet ..... 401/135
5,199,470 A 4/1993 Goldman
5,400,573 A 3/1995 Crystal et al.
5,453,772 A * 9/1995 Aono et al. ..... 347/87
5,488,400 A 1/1996 Crystal et al.
5,495,877 A 3/1996 Schwenk et al.
5,537,134 A 7/1996 Baldwin et al.
5,546,996 A 8/1996 Broyles et al.
5,572,852 A 11/1996 Crystal et al.
5,581,287 A 12/1996 Baezner et al.
5,607,003 A 3/1997 Gray
5,757,390 A * 5/1998 Gragg et al. ..... 347/7
5,819,627 A 10/1998 Hayao
5,845,682 A 12/1998 Hayao
5,912,687 A 6/1999 Cowger et al.
5,917,526 A 6/1999 Wilson et al.
5,933,175 A 8/1999 Stathem et al.
6,022,102 A * 2/2000 Ikkatai et al. ..... 347/85
6,053,603 A * 4/2000 Ito ..... 347/85
6,099,115 A 8/2000 Faoro
6,158,848 A 12/2000 Liu
6,158,851 A 12/2000 Zepeda
6,172,695 B1 1/2001 Liu (Continued)

FOREIGN PATENT DOCUMENTS

JP 09094799 4/1997

(Continued)

OTHER PUBLICATIONS

"Instructions for refilling a HP 26A/29A ink cartridge" and "Troubleshooting Guide," *Dataproducts*, 2 pgs, date unknown.

(Continued)

*Primary Examiner*—Anh T. N. Vo
(74) *Attorney, Agent, or Firm*—Merchant & Gould P.C.

(57) ABSTRACT

An ink refill device and method for refilling an ink reservoir (s) of a printer ink cartridge. The ink refill device includes an ink container that defines an internal ink tank(s) containing ink, drain and vent members that are adapted and arranged to replenish the ink reservoir(s) with ink from the ink tank(s), and a pressure varying member configured to vary a pressure condition in the internal ink tank to create ink flow in the drain conduit.

24 Claims, 7 Drawing Sheets

U.S. PATENT DOCUMENTS

| | | | | |
|---|---|---|---|---|
| 6,273,151 | B1 | 8/2001 | Kong | |
| 6,347,863 | B1 * | 2/2002 | Yuen | 347/85 |
| 6,478,415 | B2 * | 11/2002 | Barinaga et al. | 347/85 |
| 6,773,099 | B2 * | 8/2004 | Inoue et al. | 347/86 |
| 6,786,583 | B2 * | 9/2004 | Ota et al. | 347/86 |
| 6,951,388 | B2 * | 10/2005 | Sasaki | 347/86 |
| 2004/0055661 | A1 | 3/2004 | Yuen | |

FOREIGN PATENT DOCUMENTS

| | | |
|---|---|---|
| WO | WO 02/26502 A1 | 4/2002 |
| WO | WO 2004/026581 | 9/2003 |

OTHER PUBLICATIONS

"Refilling Instructions for Hewlett-Packard 51625A Print Cartridges (Kit #DJRE500C) [and] for Hewlett-Packard 51649A Print Cartridges (Kit #DJRE600C)," *Repeat-O-Type Manufacturing Corporation*, Wayne, NJ, 1 pg. (Jan. 1998).

"Canon BX-03 Printer Cartridge Refilling Instructions," http://www.pclincs.co.uk/Printer/canon_bx-03.html, 2 pages (Printed Mar. 21, 2003).

"HP 500/600 Black Refill Kit. Instructions for refilling a HP 26/A29A Ink Cartridge," 2 pages, date unknown.

"Instructions for Refilling Lexmark & Dell Color Cartridges," 1 page (2003).

"Instructions for use on cartridges Canon BCI-3eC, eM, eY, eBk," http://www.fifty.cz/English/N%C3%A1vody/aRBJ3000.htm, 1 page (Printed Mar. 21, 2003).

"Save on Ink. Frequently Asked Questions," http://trinishops.com/saveonink/faq.htm, 6 pages (Printed Mar. 21, 2003).

* cited by examiner

ACTUATOR FOR AUTOMATIC INK REFILL SYSTEM

FIELD OF THE INVENTION

The present invention generally relates to filling containers with fluid, and more specifically relates to refilling printer ink cartridges.

BACKGROUND OF THE INVENTION

Ink jet printers are a popular form of printer used with computers and similar applications involving document printing or graphics preparation. Typical ink jet printers have replaceable ink jet cartridges with built-in print heads. While replaceable ink jet cartridges are a convenient manner of supplying ink to such printers, the cartridges are necessarily expensive due to their complexity and the provision of print heads with the cartridges. Cartridges provided by manufacturers are typically not designed to be refilled when the ink supply runs out. It is well known, however, that such cartridges have useful lives significantly longer than that provided by the initial supply of ink. As a result, there have been substantial efforts directed at providing a simple, easy-to-use system for refilling cartridges with ink.

Known ink cartridge refill systems may have certain drawbacks related to ink flow from the ink refill system to the printer cartridge. Therefore, additional efforts have been directed at providing reliable, consistently functioning systems for refilling printer cartridges with ink.

SUMMARY OF THE INVENTION

The present invention provides an ink refill device and method for refilling an ink reservoir(s) of a printer ink cartridge. The ink refill device includes an ink container that defines an internal ink tank(s) containing ink, drain and vent members that are adapted and arranged to replenish the ink reservoir(s) with ink from the ink tank(s), and a pressure varying member configured to vary a pressure condition in the internal ink tank to initiate ink flow in the drain conduit.

One method according to principles of the present invention relates to refilling an ink chamber of a printer ink cartridge. The method includes coupling an ink container having at least one ink reservoir to the printer ink cartridge, coupling the at least one ink reservoir in ink flow communication with the ink chamber, coupling the at least one ink reservoir in air flow communication with the ink chamber, and altering pressure in the ink reservoir to initiate the ink flow communication.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
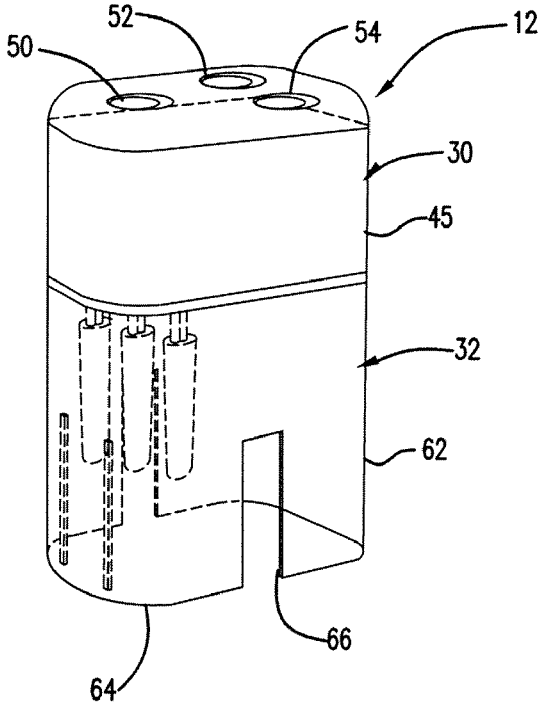
FIG. 1 is a front perspective view of an ink refill apparatus including features that are examples of how certain inventive concepts can be put into practice.
Figure 2:
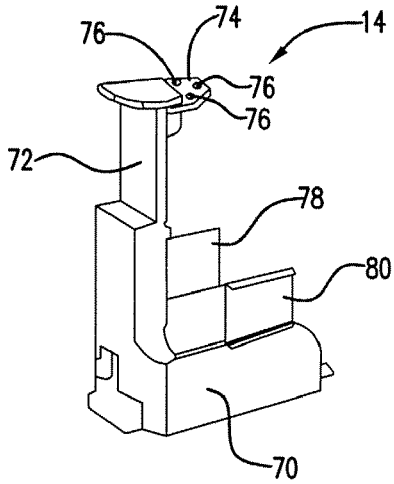
FIG. 2 is a perspective view of a refill system base including features that are examples of how certain inventive concepts can be put into practice.
Figure 3:
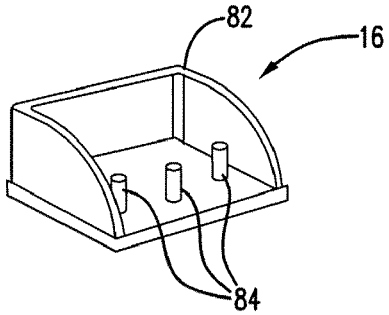
FIG. 3 is a perspective view of a printer ink cartridge fill hole opener including features that are examples of how certain inventive concepts can be put into practice.
Figure 4:
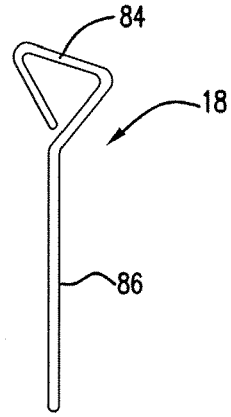
FIG. 4 is a perspective view of an example foam drill for use with a printer ink cartridge and includes features that are examples of how certain inventive concepts can be put into practice.
Figure 5:
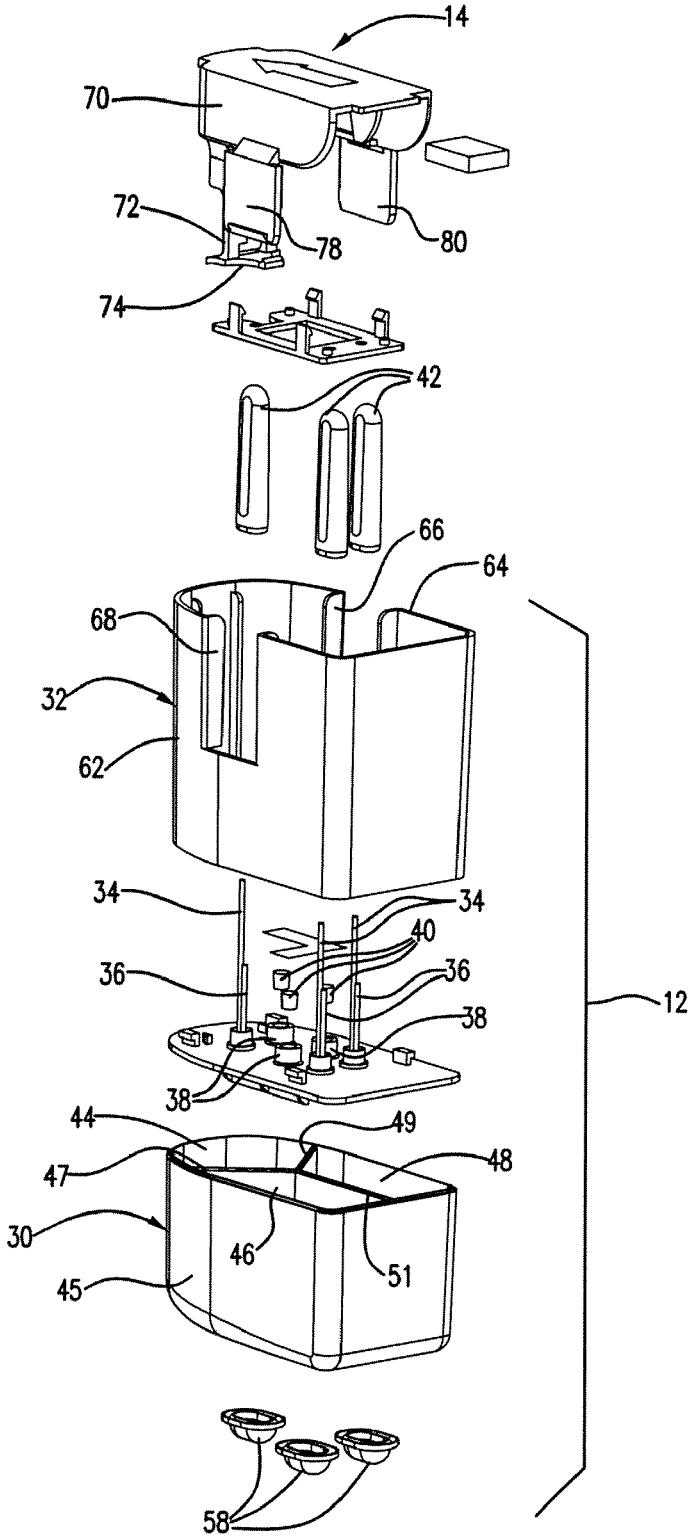
FIG. 5 is an exploded perspective view of the apparatus of FIG. 1 and the base of FIG. 2.
Figure 6:
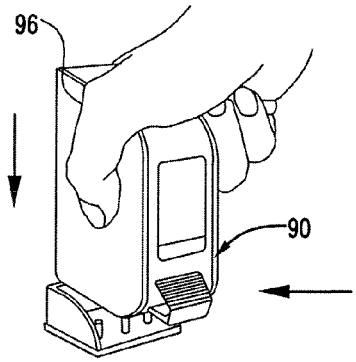
FIG. 6 is a perspective view showing engagement between a printer ink cartridge and the fill hole opener shown in FIG. 3.

The present invention provides an ink refill system for filling a refillable container such as a printer ink cartridge. The refill system includes an ink refill apparatus that includes an ink tank containing refill ink, at least one ink conduit configured to provide ink flow communication with the container to be filled, and a venting structure configured to provide venting in the container to be filled during ink flow communication. When in use, the refill apparatus facilitates ink flow from the ink tank of the ink refill apparatus to the container to be filled with ink. The following detailed description, with reference to FIGS. 1-19, describes an ink refill system, an ink refill kit that includes an ink refill apparatus, and a method of using an ink refill system.

As used herein, the terms "printer ink cartridge", "ink cartridge", "printer cartridge", and "cartridge" generally refer to an ink cartridge for an ink jet printer. A printer ink cartridge may be configured to include an inlet port that facilitates fluid communication with an interior chamber of the cartridge. The present invention utilizes such an inlet port of an ink cartridge to refill the cartridge using an easy-to-use method and apparatus, examples of which are described herein. The term "pump" is defined as any structure that causes movement of a fluid (i.e., air or liquid) when actuated. A "compressible member" is defined as a structure that can be deformed or compressed and may include similar structures such as, for example, an air bladder, a bubble structure, a diaphragm, and a packet, and may have any shape and size suitable for use with the present invention.

An example ink refill system is shown in perspective view in FIGS. 1-4. The refill system includes an ink refill apparatus 12 (see FIG. 1), a base member (see FIG. 2), a fill hole opener 16 (see FIG. 3), and a foam drill 18 (see FIG. 4), which system components have numerous features that are examples of how inventive concepts disclosed herein can be practiced. The components shown in FIGS. 1-4 may be part of a refill kit in which some or all of the components are included together in a package.

The refill apparatus 12 (see FIGS. 1, 5, 17 and 18) includes an upper housing member 30, a lower housing member 32, a plurality of drain conduits 34, a plurality of vent conduits 36, a plurality of fill openings 38, and a plurality of ink stoppers 42 associated with the pairs of conduits 34, 36. The upper and lower housing members 30, 32 are coupled together to define a cavity in which the conduits 34, 36 reside and a printer ink cartridge may be positioned for refilling.

The upper housing member 30 includes first, second, and third ink tanks 44, 46, 48 and first, second and third pump assemblies 50, 52, 54. The ink tanks 44, 46, 48 are defined by an outer wall 45, first, second and third inner walls 47, 49, 51, and a bottom wall 53 (see FIGS. 5 and 18). The pump assemblies 50, 52, 54 each include a recess 56 formed in the outer wall 45, and a compressible member 58 that defines an inner cavity or other structure that is in fluid communication with one of the ink tanks to vary a pressure condition within the ink tanks. An aperture 60 (see FIGS. 17 and 18) may be positioned between the compressible member 58 and one of the ink tanks 44, 46, 48 to facilitate fluid communication between the compressible member 58 and the ink tanks 44, 46, 48. The compressible member 58 may include a resilient, elastic material that can be pushed to compress the inner cavity of the compressible member and then expand back to the non-compressed state. In some embodiments, the compressible member 58 may be a separate member that can be coupled to the outer wall 45, while in other embodiments the compressible member 58 is integrally formed with the outer wall 45 as a continuous piece of material.

The lower housing member 32 includes a side wall 62 that is coupled to the first housing member 30 at one end and defines an opening 64 at an opposing end for receiving a printer ink cartridge for refilling. First and second track portions 66, 68 are formed in the side wall 62 and are configured as guides for aligning a printer ink cartridge relative to the conduits 34, 36 for refilling the cartridge (see FIGS. 1, 5 and 11). The side wall 62 may have other features formed therein to assist in aligning and maintaining the printer ink cartridge in a desired refill position. In other embodiments (not shown), the ink refill apparatus may include only an upper housing member, which configuration would require a more manual alignment of the printer ink cartridge with the conduits 34, 36. In still further embodiments (not shown), the first and second housing members 30, 32 may have different shapes and sizes to accommodate different styles and brands of printer ink cartridges and different amounts and colors of ink.

The upper and lower housing members 30, 32 may include a transparent or translucent material, such as, for example, a clear polymer material that permits visualization of the ink held in the ink tank and alignment of an printer cartridge in the lower housing member 32. In one embodiment, the upper and lower housing members 30, 32 include a rigid or semi-rigid material except for those portions of the housing members that include a more resilient and deformable material or structure that functions to vary a pressure condition in the ink tanks 44, 46, 48.

The drain conduits 34 having first and second ends 33, 35 (see FIGS. 17 and 18), with the first end 33 being exposed to ink within one of the ink tanks 44, 46, 48 and the second end 35 being exposed outside of the upper housing member 30. Preferably, the first end 33 is oriented at or near the bottom internal wall 53 of the upper housing member 30 to facilitate a complete emptying of the ink tank. The vent conduit 36 has first and second ends 37, 39 (see FIG. 17), with the first end 37 being exposed to air within one of the ink tanks 44, 46, 48 and the second end 39 being exposed outside of the upper housing member 30 (see FIGS. 10-14, 17 and 18).

The fill openings 38 (see FIGS. 5, 17 and 18) may each include a seal member 40 that controls access through the openings 38 into one of the tanks 44, 46, 48. The seal member may be a reusable gasket that is removable and replaceable in the fill openings 38, or may be a pierceable member that maintains a seal even after pierced by a refilling structure such as a needle.

Figure 10:
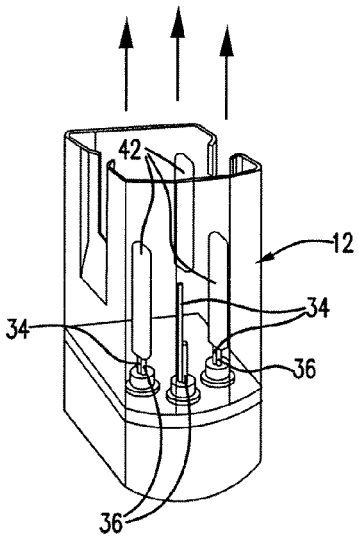
FIG. 10 is a perspective view showing ink tank stoppers being removed from the ink refill conduits of the ink refill apparatus shown in FIG. 1.
Figure 14:
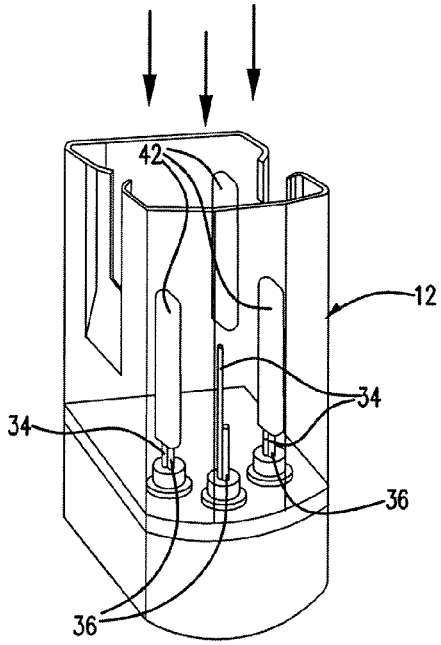
FIG. 14 is a perspective view showing replacement of the ink tank stoppers onto the ink refill conduits of the ink refill apparatus shown in FIG. 1.
Figure 16:
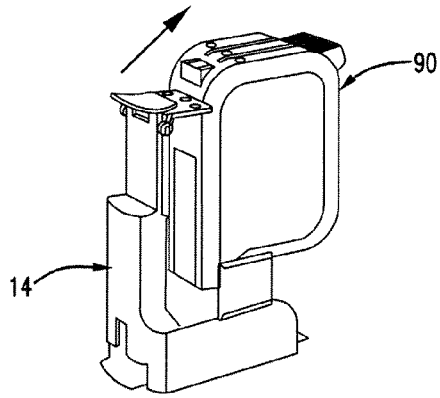
FIG. 16 is a perspective view of the printer ink cartridge shown in FIG. 15 being removed from the base.
Figure 18:
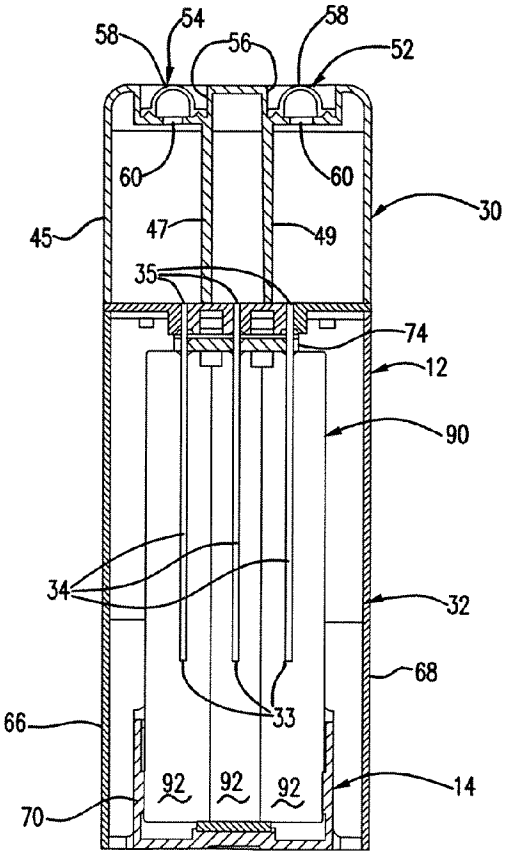
FIG. 18 is a cross-sectional view of the assembly shown in FIG. 12 taken along cross section line 18-18.
Figure 17:
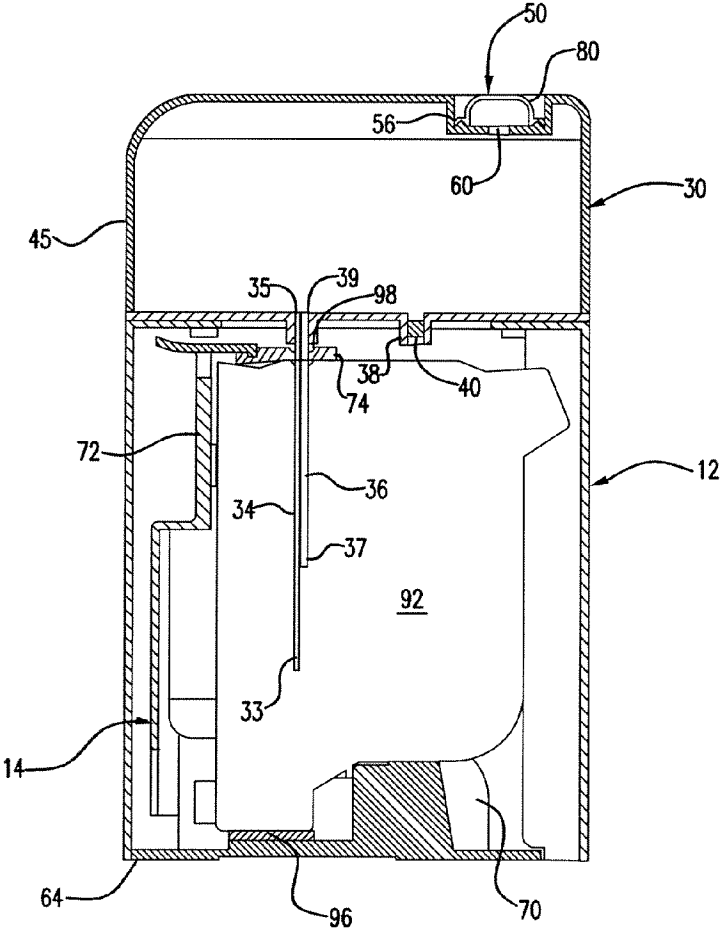
FIG. 17 is a cross-sectional view of the assembly shown in FIG. 12 taken along cross section line 17-17.
Figure 19:
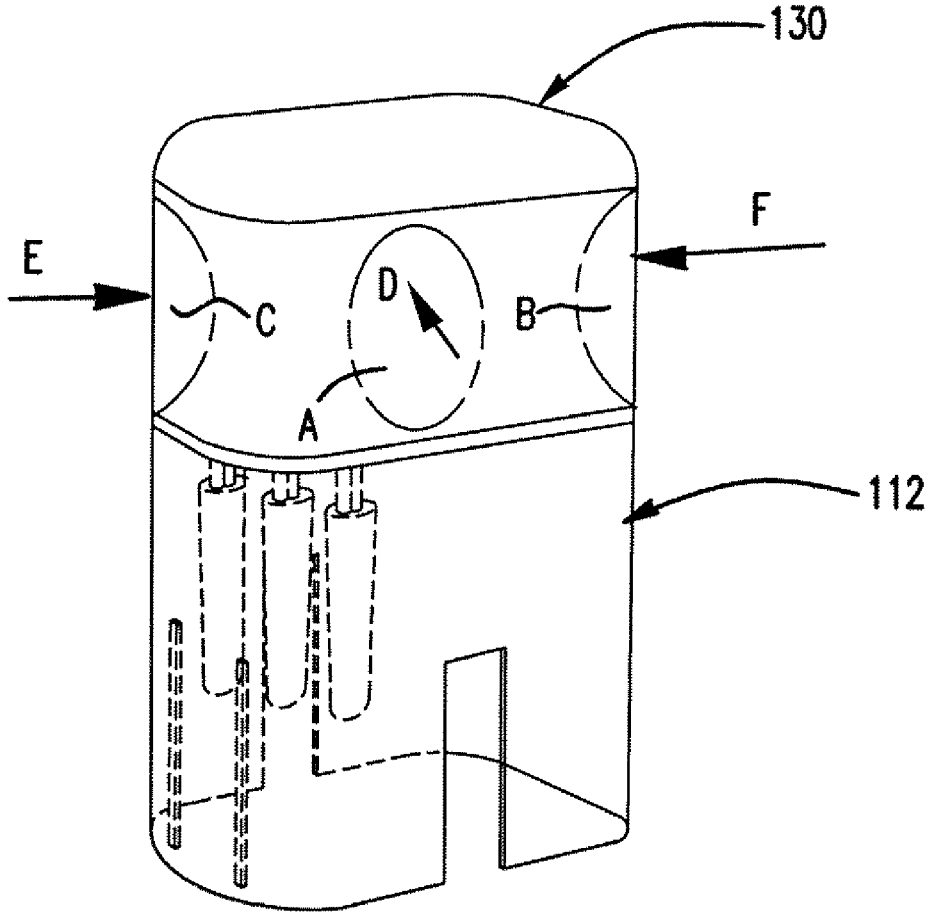
FIG. 19 is a perspective view of another example ink refill apparatus that includes a compressible side wall according to principles of the present invention.

The ink stoppers 42 may be used to cover the conduits 34, 36 individually or in pairs of drain and vent conduits as shown in FIGS. 1, 10 and 14 in order to prevent ink from flowing out of the conduits 34, 36 when the conduits 34, 36 are not inserted into a printer ink cartridge. The ink stoppers 42 may have different configurations in other embodiments (not shown) for example, for coupling to individual conduits or for coupling to more than two conduits at the same time.

Figure 8A:
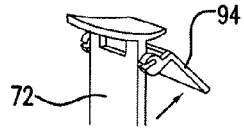
FIGS. 8A and 8B are perspective views showing preparation of the base shown in FIG. 2 for receiving an printer ink cartridge.
Figure 8B:
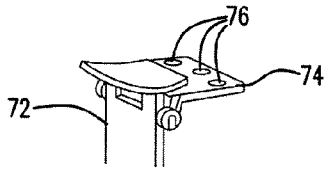
Figure 7:
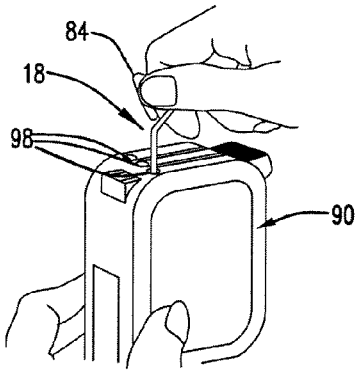
FIG. 7 is a perspective view showing insertion of the foam drill shown in FIG. 4 into fill holes of an ink cartridge.

The base member 14 (see FIGS. 2, 5, 8A, 8B, 9, 12, 13 and 15-18) includes a cartridge seat 70, a guide support 72, a guide 74 having a plurality of apertures 78, and first and second latch arms 78, 80. The cartridge seat 70 may be configured to receive a printer ink cartridge 90 in a upright position with a print head 96 of the cartridge 90 oriented downward in the seat 70 and a plurality of fill holes 98 of the cartridge 90 oriented upward. When the cartridge 90 is positioned in the seat 70, the guide support 72 holds the guide 74 in a position adjacent the fill holes 98 of the cartridge 90. As shown in FIGS. 8A and 8B, the guide 74 may be movable between lowered and raised positions (respectively), wherein when in the raised position the guide is positioned to support the cartridge 90 with the conduit apertures 76 in alignment with the fill holes 98. In some embodiments, the guide 74 may be biased into a raised position so the guide 74 is prepared to receive the cartridge 90, or may be biased into a closed position thereby providing a biasing force against the cartridge to assist in holding the cartridge in a mounted position in the base 14.

The latch arms 78, 80 extend from the cartridge seat 70 and are configured to engage and releaseably latch with the first and second track portions 66, 68 formed in the lower housing member 32. The latch arms 78, 80 may include snap-fit or interference fit features that provide for a quick release of the base 14 from the ink refill apparatus 12. The base 14 may include other features that engage features of the ink refill apparatus to facilitate alignment of the conduits 34, 36 in the fill holes 98 of the cartridge 90 and coupling of the base 14 to the ink refill apparatus 12 when the combined cartridge 90 and base 14 are inserted into the ink refill apparatus 12.

The fill hole opener 16 (see FIGS. 3 and 6) includes a plurality of fill hole drivers 84 configured to engage and remove fill hole plugs (not shown) from the fill holes 98, and a guide member 82 that supports an end of the cartridge 90 when the drivers 84 are brought into engagement with the fill hole plugs. Removal of the fill hole plugs from the fill holes 98 is typically necessary in order to refill the cartridge 90 with refill ink.

The foam drill 18 includes a handle portion 84 and a drill portion 86, and is configured for insertion into the fill holes 98 of the cartridge 90 to engage and drill foam 92 (see FIGS. 17 and 18) within the cartridge 90 thereby opening a channel for increased ink flow into the cartridge 90. The drill portion 86 may, in other embodiments, include additional drilling features such as a pointed end, a protrusion extending laterally from the drill portion, or other feature that facilitates increased drilling of the cartridge foam 92.

According to a method of using the ink refill system of the present invention, the various features shown in FIGS. 1-4, 17 and 18 are used according to the steps shown in FIGS. 6-16. An empty or at least partially empty printer ink cartridge 90 is prepared for refilling by first being brought into engagement with the fill hole opener 16 to remove the fill hole plugs (not shown) from the cartridge 90 thereby opening the fill holes 98 (see FIG. 6). The drill portion 86 of the foam drill 18 is then inserted into the fill holes 98 (see FIG. 7) to open an ink flow passage in the foam 92 (see FIGS. 17 and 18) of the cartridge 90. The foam drill 18 may be rotated with the handle portion 84 to facilitate opening an ink flow passage in the foam 92 sized to receive the tubes 34, 36. This drilling action may be performed for each of the fill holes 98 and repeated as necessary to move or loosen the foam 92 for later insertion of the tubes 34, 36. Drilling the foam 92 with the foam drill 18 may also prevent damage to the foam that may otherwise occur, which damage may affect ink dissipation from the cartridge 90. If the cartridge 90 includes different colors in separate chamber that are accessible through separate fills holes 98, it is recommended that the foam drill 18 be wiped off before insertion into separate fill holes.

Figure 9:
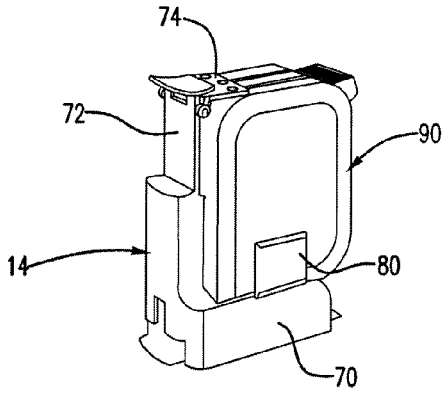
FIG. 9 is a perspective view showing a printer ink cartridge mounted in the base shown in FIG. 2.

The base 14 is prepared for receiving the cartridge 90 by lifting the guide 74 from a lowered position (see FIG. 8A) to a raised position (see FIG. 8B), and the cartridge 90 is mounted in the cartridge seat 70 with the fill holes 98 of the cartridge 90 in alignment with the conduit apertures 76 in the guide 74 (see FIG. 9). In some embodiments, the base 14 may include locking features that provide a latching or other type of positive attachment of the cartridge 90 to base 14.

The ink refill apparatus 12 is prepared for receiving the printer cartridge 90 by turning the apparatus 12 upside down with the opening 64 of the lower housing 32 facing upward and the ink stoppers 42 accessible for removal (see FIG. 10). Slowly removing the ink stoppers 42 exposes the conduits 34, 36 and reduces splattering of ink held in the ink stoppers 42. The combined base 14 and cartridge 90 are then lowered into the second housing member 32 with the latch arms 78, 80 in alignment with the first and second track portions 66, 68, and the conduits 34, 36 in alignment with the fill holes 98 of the cartridge 90 (see FIG. 11). In some embodiments, the latch arms 78, 80 may latch or otherwise releaseably lock into place relative to the lower housing member 32 at a predetermined position wherein the conduits 34, 36 are properly positioned within the fill holes 98.

Figure 12:
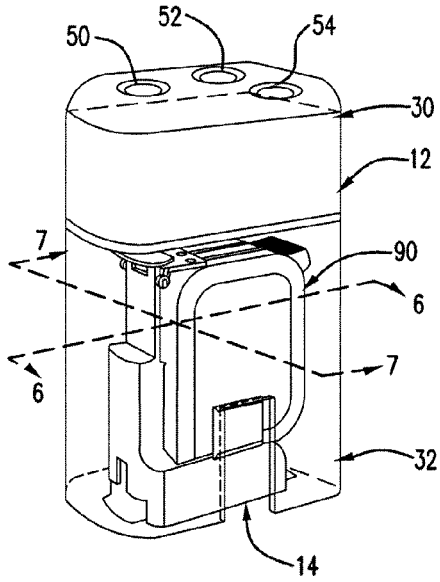
FIG. 12 is a perspective view showing the ink refill apparatus shown in FIG. 1 positioned to fill a printer ink cartridge.
Figure 11:
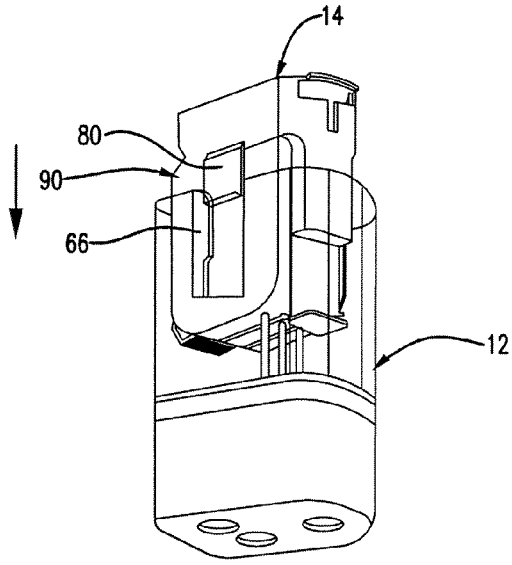
FIG. 11 is a perspective view showing insertion of the combined printer ink cartridge and base shown in FIG. 4 into the ink refill apparatus shown in FIG. 1.
Figure 13:
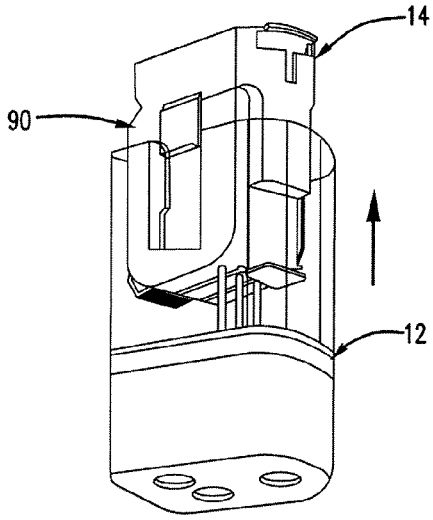
FIG. 13 is a perspective view showing removal of the combined printer ink cartridge and base shown in FIG. 4 from the ink refill apparatus shown in FIG. 1.
Figure 15:
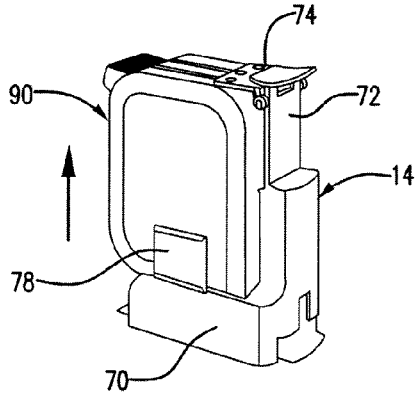
FIG. 15 is a perspective view showing the combined printer ink cartridge and base with the printer ink cartridge at least partially refilled and prepared for removal from the base.

With the cartridge 90 and base 14 coupled to the ink refill apparatus 12, the assembly of components is turned upright with the upper housing 30 vertically above the cartridge 90 (see FIG. 12). Preferably, the outer wall 45 of the upper housing 30 is transparent so that a user can watch for bubbles rising in the ink tanks 44, 46, 48, which bubbles indicate ink flow through the drain conduits 34 into the cartridge 90. If ink does not flow automatically (as indicated by the generation of bubbles in the ink tanks or the lowering of ink levels in the ink tanks), the compressible member 58 of the pump assembly 50, 52, 54 associated with the stagnant ink tank may be compressed/engaged thereby changing a pressure condition in the associated ink tank (e.g., the pressure in the ink tank will increase when the corresponding pump assembly is engaged/compressed). Changing a pressure condition in the ink tank initiates ink flow in the drain conduit 34. Once ink flow is initiated in each of the desired drain conduits, the cartridge will automatically fill with ink until filled to a predetermined level established by the configurations of the drain and vent conduits 34, 36.

A filled condition in the cartridge 90 is typically manifest when there are no longer bubbles being formed in the ink tanks 44, 46, 48 and the ink levels in the ink tanks 44, 46, 48 is no longer changing. Once the cartridge 90 is filled to the desired level, the assembly is turned upside down again (see FIG. 13), the combined cartridge 90 and base 14 are removed from the ink refill apparatus 12 (see FIG. 13) and turned upright again (see FIG. 15), the ink stoppers 42 are replaced on the conduits 34, 36 (see FIG. 14), and the filled cartridge 90 is removed from the base 14 (see FIG. 16).

After completing the process of filing cartridge 90, the user may check for ink flow from print head 96. If there is not ink already shown on print head 96 (which would indicate that cartridge 90 is ready for use), the user may imprint or press print head 96 on a tissue to see if there is any ink in the print head that will flow into the tissue. If there is no ink in print head 96, the user may force ink into print head 96 by inserting a blower (not shown) into a breather hole or other venting opening in the cartridge 90 to force ink into the print head 96. When ink appears on print head 96 or if ink flows onto a tissue against which print head 96 is imprinted, cartridge 90 is ready for use.

In operation, the invention is based on the general principle that, in a closed system, the flow of a liquid out of a system must be balanced by an equal volume of fluid into the system. Thus, the ink refill apparatus consists of three basic elements: an enclosed ink tank filled with ink, a drain conduit, and a vent conduit. The open lower ends of the drain and vent conduits are inserted into the lower bottom portion of a printer ink cartridge. If the ink level in the cartridge is low, ink flows out of the drain conduit and seeps into the foam of the cartridge, causing a vacuum pressure condition in the ink tank that acts to draw air up through the vent conduit into the ink tank. When the ink level in the cartridge rises to the lower opening of the vent conduit, the ink seals the vent conduit so that air can no longer get into the ink container, thus shutting off the ink flow into the cartridge. Thus, a refill system can be designed to fill a cartridge to a predetermined level based on the length of the vent conduit. Some embodiments may include separate vent openings for the ink tank and the cartridge that are not be in fluid communication with each other. In such a configuration, the ink would flow in the drain conduit until the cartridge is filled to the level of the vent. This type of configuration may result in less control over predetermined ink levels in the cartridge as compared to the system described above with reference to FIGS. 1-18 and may have a problem with ink leakage out of the vent opening in the cartridge.

The present invention is clean and "automatic" in that it operates on gravity. In theory, the flow of ink through the drain conduits should be automatic so long as the ends of the vent conduit are exposed to air. However, in some cases the surface tension between ink residing in the drain conduits (and sometimes in the vent conduits) and the conduit walls may be greater than the capillary forces trying to pull ink downward from the ink tank. In this condition, the capillary forces are not sufficient to initiate fluid flow in the drain conduit. As a result, a stagnant ink condition may exist that prohibits ink flow into the cartridge and cannot be overcome without imposing some type of externally applied force to the refill system. The use of a pressure member in association with the ink tank can alter a pressure condition in the ink thereby providing the necessary intervening force to initiate ink flow in the drain conduit (and possibly clear ink out of the vent conduit). Either increasing or decreasing pressure in the ink tank with the pressure member can initiate fluid flow, in particular ink flow, in the conduits.

The use of a small pump member (for example, compressible member 58 shown throughout FIGS. 1-18) to create a change in pressure in the ink tank of the upper housing member of the ink refill apparatus addresses the needs of the gravity based refill system as set forth above. In a more broad view of the present invention, the invention may be practiced without individual pump assemblies and compressible members. For example, the upper housing or discrete portions of the ink refill apparatus such as portions of the outer wall of the upper housing may be made of a pliable, resilient material that facilitates "squeezing" of the ink tank by a user, thereby changing a pressure condition in the ink tanks to initiate ink flow in the drain conduits. Such an ink refill apparatus 112 (see FIG. 19) may be easily formed by merely changing the materials or the material thicknesses used in an upper housing 130 of ink refill apparatus 112 so as to provide some portions of the upper housing 130 that are more resilient and deformable than other areas. The changed materials or material characteristics may be localized in discrete areas, for example, as represented by compression areas A, B, C in FIG. 19. These compression areas A, B, C may be engaged in a direction indicated by arrows D, E, F, respectively by a user to vary the pressure in an ink tank of apparatus 112. Such modifications could be made to the ink refill system shown and described in U.S. Pat. No. 6,347,863, which patent is incorporated herein by reference in its entirety.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An ink cartridge refill system configured to refill an ink cartridge, the system comprising:

an ink supply unit including a first portion and a second portion, wherein the first portion includes a plurality of ink tanks;

a drain conduit extending from the first portion of the ink container to the second portion of the ink container;

a vent conduit extending from the first portion of the ink container to the second portion of the ink container, wherein the vent conduit and drain conduit are configured for simultaneous fluid flow and wherein the fluid flow in the drain conduit is configured to automatically stop when the fluid flow in the vent conduit is stopped; and a pressure varying means configured to alter a pressure condition in the internal ink tank of the ink supply unit to generate ink flow in the drain conduit, wherein the pressure varying means is operatively mounted to the ink tanks and includes a pliable portion of a wall of the ink supply unit.

2. The system according to claim 1, wherein the cartridge seat includes a drain conduit guide that is configured to receive a portion of a drain conduit.

3. The system according to claim 1, further comprising a cartridge seat configured to mount to an ink cartridge and engage the second portion of the ink container.

4. The system according to claim 1, wherein the pliable portion is located on the exterior of the first portion of the ink container.

5. The system according to claim 1, wherein the second portion of the ink supply unit is configured to be mounted over an ink cartridge.

6. An ink cartridge refilling system configured to refill an ink cartridge, the system comprising:

an ink supply unit having an upper portion including at least one ink reservoir and a lower portion configured to be mounted over an ink cartridge;

at least one ink communication path extending through the lower portion of the ink supply unit configured to connect the ink reservoir with the ink cartridge housing interior;

at least one vent communication path extending through the lower portion of the ink supply unit configured to connect the ink reservoir with the ink cartridge housing interior; and a pliable portion on the upper portion of the ink supply unit, the pliable portion providing a fluid-tight seal with the exterior surface of the ink supply unit.

7. The system of claim 6, wherein said ink communication path comprises an elongated ink conduit configured to extend from the at least one ink reservoir into the ink cartridge housing interior.

8. The system of claim 6, wherein the ink communication path includes an ink flow aperture configured to connect the ink reservoir with the ink cartridge housing interior.

9. The system of claim 6, wherein the pliable portion is configured such that when pressure is applied thereto ink flows through the drain conduit while the ink cartridge and ink supply unit maintain a fixed spatial relationship relative to each other.

10. The system of claim 6, wherein the pliable portion includes a deformable air-filled bladder member.

11. The system of claim 6, wherein the ink supply unit includes a plurality of ink reservoirs, each ink reservoir being fitted with drain and vent conduits and a pressure member.

12. The system of claim 6, wherein the pliable portion includes a flexible, resilient housing defining an internal chamber that is in fluid communication with the at least one ink reservoir.

13. The system of claim 6, wherein the pliable portion includes a button shaped actuating member that can be depressed to initiate ink flow.

14. The system according to claim 6, wherein the at least one ink communication path and the at least one vent communication path are configured for simultaneous fluid flow and wherein the fluid flow in the ink communication path is configured to automatically stop when the fluid flow in the vent communication path is stopped.

15. A method of refilling an ink cartridge, the method comprising steps of:

mounting an ink cartridge in a refill base member;

connecting the refill base member with an ink supply unit such that the ink cartridge is in both air flow and ink flow communication with the ink supply unit;

orienting the ink supply unit so that it is elevated above the ink cartridge;

varying pressure in the ink reservoir to initiate the ink flow communication while maintaining a fixed spatial relationship between the ink container and the ink cartridge; and automatically discontinuing the ink flow when the air flow between the ink supply unit and the ink cartridges stops.

16. The method of claim 15, further comprising the step of opening refill holes into the housing interior of the ink cartridge.

17. The method of claim 16, further comprising the steps of inserting a foam drill into the refill holes and engaging the foam within the housing interior with the foam drill.

18. The method of claim 15, wherein coupling the at least one ink reservoir in ink flow communication includes extending an ink conduit between the ink reservoir and the ink chamber.

19. The method of claim 15, wherein coupling the at least one ink reservoir in air flow communication includes extending an air conduit between the ink reservoir and the ink chamber.

20. The method of claim 15, wherein the step of connecting the refill base member with an ink supply unit comprises the step of removing ink stoppers from the ink supply unit.

21. The method of claim 15, wherein after ink flow is initiated using the force of gravity to maintain the ink flow.

22. An ink cartridge refill kit, comprising:

a package;

an ink supply unit positioned in the package, the ink supply unit including an internal ink tank, a drain conduit, a vent conduit, a pressure varying member, and an ink stopper, the drain conduit being in ink flow communication with the internal ink tank, the vent conduit being in air flow communication with the internal ink tank, and the pressure varying member being configured to alter a pressure condition within the internal ink tank, the ink stopper configured to prevent ink from spilling out of the drain conduit; and an ink cartridge carrying base positioned within the package, the printer ink cartridge carrying base being configured to retain an ink cartridge, and configured to operatively mount to a bottom portion of the ink supply unit.

23. The kit of claim 22, further comprising a fill hole opening device positioned within the package, the fill hole opening device being configured to dislodge fill hole plugs covering ink fill holes of an ink cartridge.

24. The kit of claim 22, further comprising a foam drill positioned within the package, the foam drill being configured to be inserted into the fill holes and engage foam within the ink cartridge.

* * * * *